US005941141A

United States Patent [19]

Whitley

[11] Patent Number: 5,941,141

[45] **Date of Patent: *Aug. 24, 1999**

[54] INDEXIBLE WRENCH

[75] Inventor: Lowell Blake Whitley, Arlington, Tex.

[73] Assignee: Stanley Mechanics Tools, Inc., Dallas, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/725,059

[22] Filed: Oct. 2, 1996

[51] Int. Cl.[6] ..... B25B 13/46

[52] U.S. Cl. ..... 81/63.1; 81/60; 81/177.8; 403/97; 403/93

[58] Field of Search ..... 81/58, 60, 61, 81/62, 63, 63.1, 63.2, 177.8, 177.9, 177.7, 342, 345, 346, 349, 443; 403/97, 96, 93, 92, 91, 103

[56] References Cited

U.S. PATENT DOCUMENTS

| | | | |
|---|---|---|---|
| 2,420,132 | 5/1947 | Gryniuck | 81/58 |
| 2,921,773 | 1/1960 | Hoelzer | 81/177.8 |
| 3,583,734 | 6/1971 | Magi | 403/96 |
| 3,605,521 | 9/1971 | Glenn | 74/548 |
| 4,406,186 | 9/1983 | Gummow | 81/60 |
| 5,419,221 | 5/1995 | Cole | 81/177.8 |

*Primary Examiner*—David A. Scherbel
*Assistant Examiner*—Joni B. Danganan
*Attorney, Agent, or Firm*—Standley & Gilcrest

[57] ABSTRACT

An indexible tool (for example a wrench) in which the handle of the tool stays in a constant horizontal plane with respect to the horizontal plane of the head of the tool and the tool has locked and unlocked positions through a movable splined pin connecting the head and the handle of the tool.

19 Claims, 10 Drawing Sheets

INDEXIBLE WRENCH

BACKGROUND AND SUMMARY OF THE INVENTION

The present invention relates generally to wrenches and, more particularly, the present invention relates to an indexible wrench that includes a handle which allows positioning of the handle with respect to the head of the tool in a plurality of locking positions in plane with the working surface.

The present invention has a wide variety of applications to hand tools. For example, the invention is useful for ratchets, multi-pivot handle tools, wrenches, adjustable wrenches, torque wrenches, as well as many other applications that will be apparent to one of ordinary skill in the art. The following description of the invention is directed to a ratchet embodiment to keep the description clear and readily understandable. Application of the invention to other tools will be readily apparent from the following description and drawings.

With the present invention locking and unlocking of the head is feasible with one hand. One embodiment of the invention includes a floating pin connecting the head to the handle of the tool, actuated up to unlock a splined joint. The handle of the tool is rotated into position and the pin is pushed down (from the top) to lock (engage) the splined pin. In this manner, the tool allows for speed ratcheting with the handle bent at 90° and unlocked, or speed turning through a total of 360°.

The splined pin has a male spline on its external surface which has a number of radial reliefs in the spline area in contact with the handle. The head of the tool has a mating female spline. The handle of the tool also has radial reliefs (off set), allowing the spline to engage and disengage with a simple, small axial motion. In this manner, the tool allows for the head to lock in various increments through 360° around a pivot axis. The splined pin remains enclosed within the head and handle joint which is preferable since foreign object damage may occur to the pin if it were exposed. The tool is compatible with a pear head design or a round head design.

The wrench includes a head, a handle connected to the head, a pin connecting the head to the handle, the pin extending through an orifice in the head and the handle, the pin adapted to reside in one of two positions, a locked position and an unlocked position, in the locked position the pin having male splines in a mating position with female splines and in the unlocked position the male splines of the pin being freely movable through a spline relief area of the orifice, wherein the handle is adapted to move through a total of 360° with respect to the head and wherein the horizontal plane of the handle is in a continuously constant relationship to the horizontal plane of the head. The wrench can incorporate a ball detent in the pin in the locked position. The wrench can be a ratchet.

Another embodiment is a ratchet wrench including a ratchet head including a traditional ratchet for rotating a shank about an axis, a handle connected to the ratchet head, a pin connecting the ratchet head to the handle, the pin extending through an orifice in the head and the handle, the pin adapted to reside in one of two positions, a locked position and an unlocked position, in the locked position the pin including a portion having male splines adapted to engage female splines of the orifice, and in the unlocked position the male splines of the pin being disengaged thereby allowing the pin to be freely movable within the orifice, and wherein the handle is adapted to move through a total of 360° with respect to the head and wherein the horizontal plane of the handle is in a continuously constant relationship to the horizontal plane of the head.

In another preferred embodiment, the invention includes one or more thrust gears on a pin which engages a splined orifice in the head of the tool. The thrust gear(s) is actuated by a push button or switch mechanism to engage the splines of the orifice. The wrench includes a head, a handle connected to the head, a pin connecting the head to the handle, the pin extending through an orifice in the head and the handle, the pin adapted to reside in one of two positions, a locked position and an unlocked position, in the locked position the pin having an extendible portion including male splines which may engage female splines of the orifice when in a locked position, and in the unlocked position the extendible portion being retracted, enabling the pin to move freely through the orifice, wherein the handle is adapted to move through a total of 360° with respect to the head and wherein the horizontal plane of the handle is in a continuously constant relationship to the horizontal plane of the head.

Another embodiment of the tool includes a head, a handle connected to the head, a pin connecting the head to the handle, the pin extending through an orifice in the head and the handle, the pin adapted to reside in one of two positions, a locked position and an unlocked position, in the locked position the pin having at least one extendible thrust gear including male splines which may engage female splines of the orifice when in a locked position, and in the unlocked position the at least one thrust gear being retracted, enabling the pin to move freely through the orifice, wherein the handle is adapted to move through a total of 360° with respect to the head and wherein the horizontal plane of the handle is in a continuously constant relationship to the horizontal plane of the head. The benefits described above with respect to the first embodiment are also found in this preferred embodiment.

The indexible wrench of the present invention is useful to tighten or loosen a fastening device where there is but limited access to the fastener in a circle around the fastener and where there is no access to the fastener at any substantial distance away from the fastener in the direction of the longitudinal axis of the fastener.

DETAILED DESCRIPTION OF PREFERRED EMBODIMENT

Figure 1:
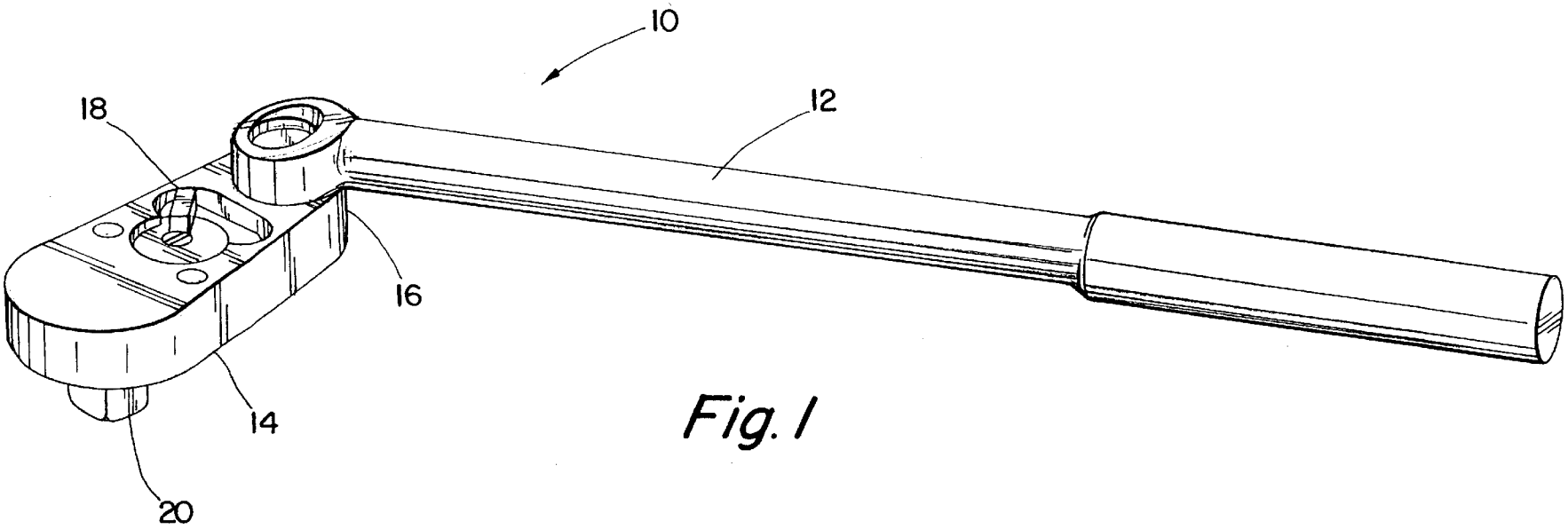
FIG. 1 shows a perspective view of one embodiment of the tool of the present invention.

Referring now to the drawings, and particularly FIG. 1, there is shown generally at 10, the tool of the present invention. The tool 10 includes a handle 12 and a ratchet head 14. A joint 16 connects the handle 12 to the ratchet head 14 and enables the handle to move up to 360° with respect to the head. The ratchet head has the standard toggle switch 18 and shank 20 commonly found in ratchets.

In operation, the handle is movable from a first position where it is locked against angular movement with respect to the ratchet head and the shank, and a second position wherein the handle is freely rotatable through a horizontal plane enabling the head and shank to rotate through 360° about the vertical axis of the shank.

Figure 2:
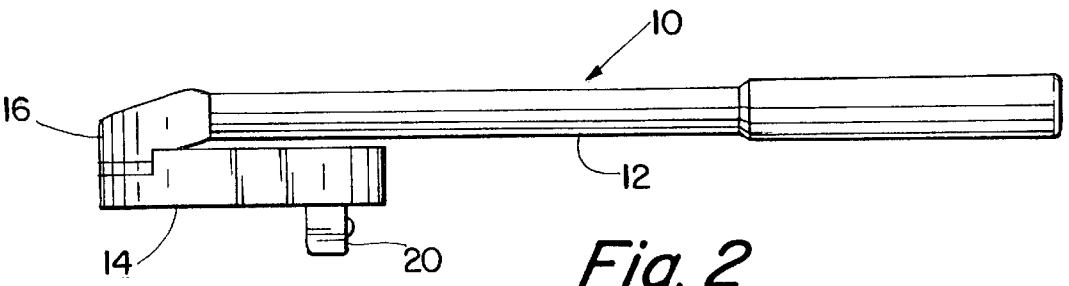
FIG. 2 shows an elevation view of the tool of FIG. 1.
Figure 3:
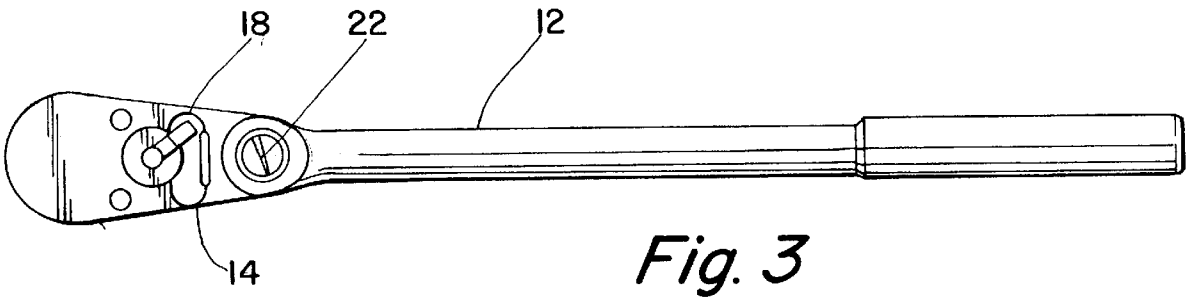
FIG. 3 shows a plan view of the tool of FIG. 1.
Figure 4:
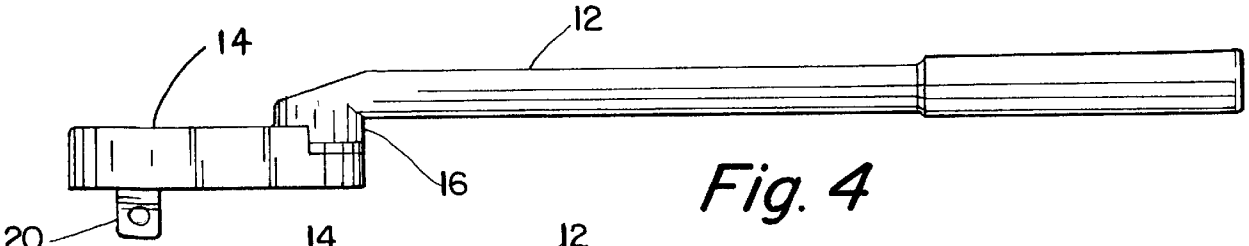
FIG. 4 shows an elevation view of the tool of FIG. 1 with the head in a position 180° from the head position shown in FIG. 2.
Figure 5:
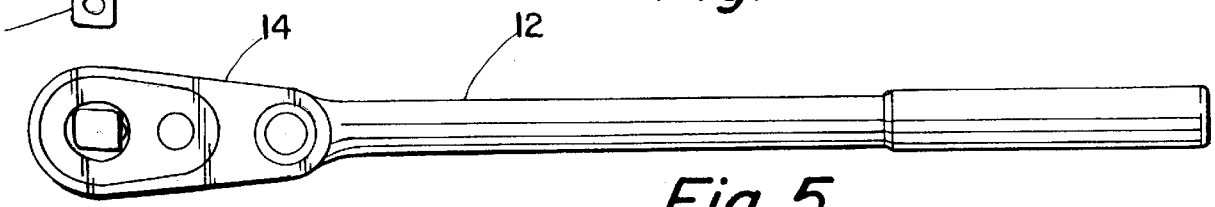
FIG. 5 shows a plan view of the opposing side of the tool from that shown in FIG. 3.
Figure 6:
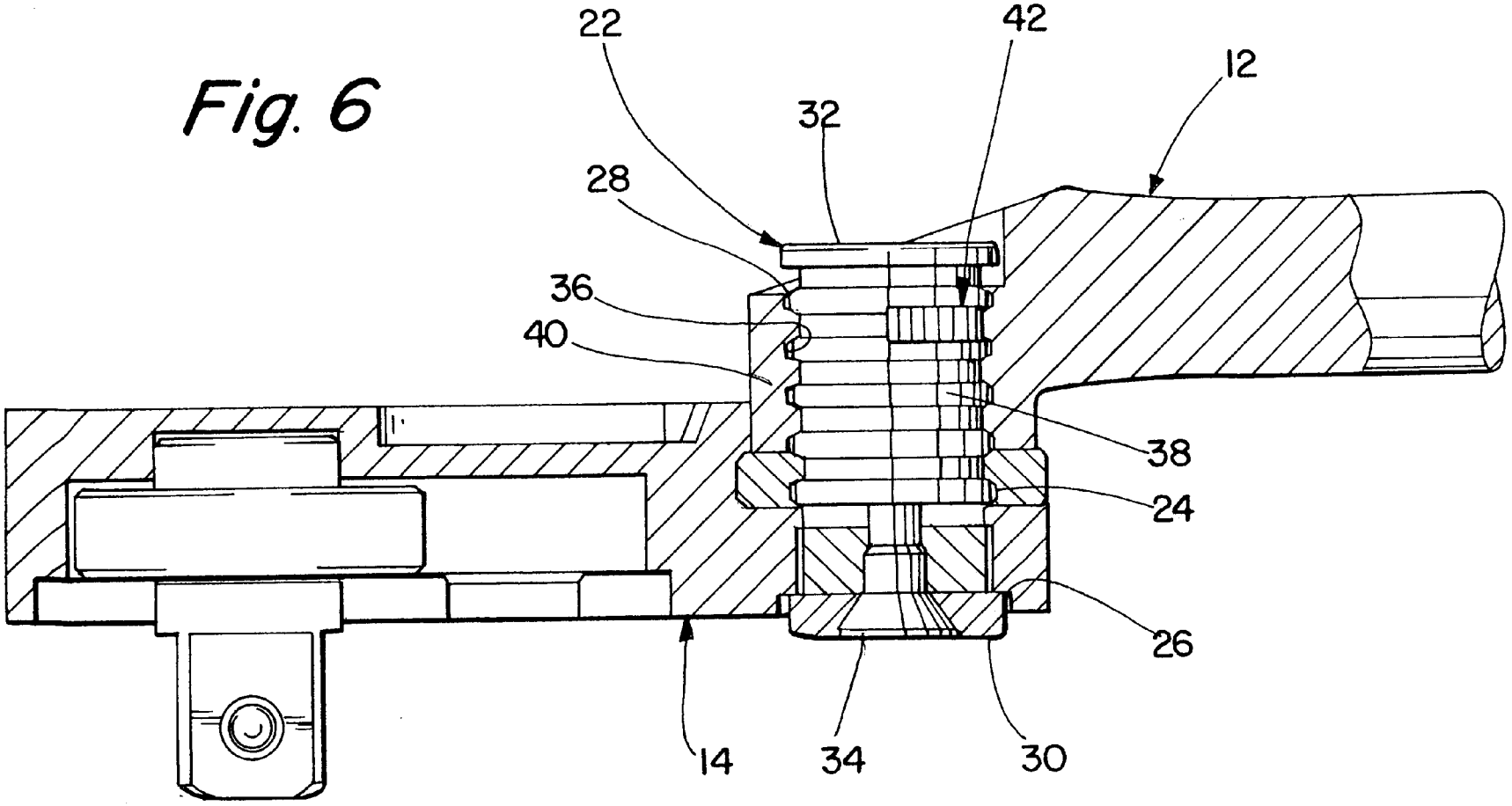
FIG. 6 shows a cross-sectional view of the head and handle pin connection of the tool of the present invention.

As shown in FIGS. 2 and 4, the handle is rotatable about the head and the head is rotatable with respect to the handle via the joint 16. As shown in FIGS. 3, 5 and 6 the joint contains a splined pin 22 which in one position locks the handle with respect to the head and in a second position frees the handle and the head to move with respect to each other.

FIG. 6 illustrates one embodiment of the splined pin and joint of the present invention in greater detail. A splined pin resides within a cavity 24 formed by the joint where the head and handle of the tool are assembled together. At each end of the cavity is a slightly larger diameter ledge 26, 28 which is designed to catch the cap 30 or top 32 of the splined pin and thereby prevent the pin from sliding out of the cavity. At one end of the pin a cap 30 may be secured to the pin with a retention screw 34. A similarly designed cap or top 32 may reside at the opposite end of the pin 22. The cavity includes spline reliefs 36 and female splines 37 while the pin includes a plurality of splines 38. A spline bushing 40 may be used to connect the handle to the head of the tool while at the same time accommodating the splined pin. A spring and ball detent 42 may be incorporated in the pin and head or handle portion of the cavity to cause the pin to stay in a locked position when unlocking the handle with respect to the head is desired. As shown in FIG. 6, the pin is in the up or unlocked position. The cap 30 is biasing against the ledge 26 within the head 14. In the unlocked position the splines on the tool reside in a spline relief area of the spline bushing enabling the handle and head to turn with respect to each other through a total of 360° (in this embodiment in 15° indexible increments). In the locked position, the pin is moved by the user down to cause the top 32 to bias against the ledge 28. The mating splines of the pin are engaged in the locked position.

Figure 7:
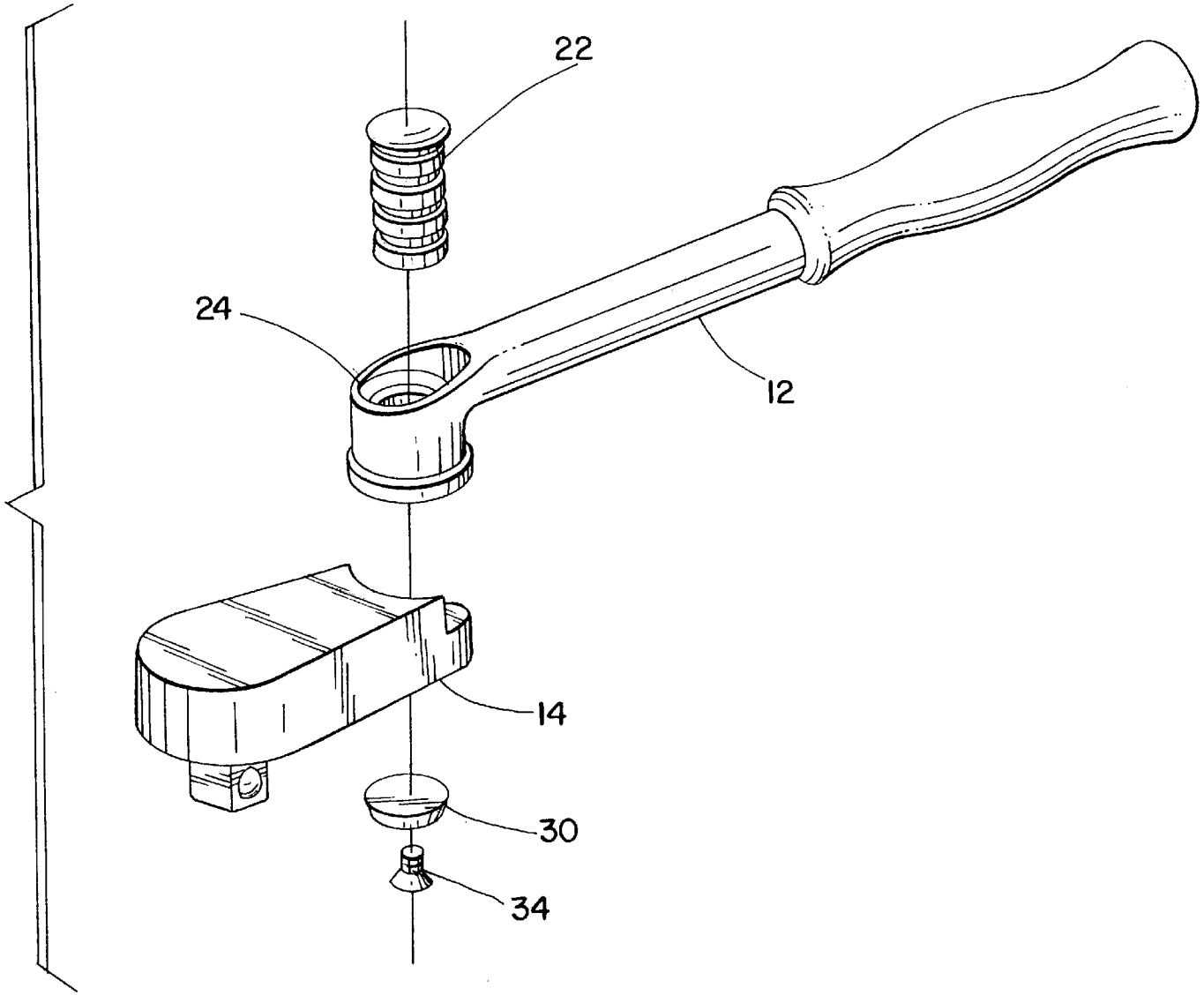
FIG. 7 shows an exploded view of the tool of the present invention.

FIG. 7 shows an exploded view of the tool. The tool contains a splined pin 22 connecting the handle 12 to the ratchet head 14. The splined pin is inserted into an orifice or cavity in the handle and the head. A cap and retainer screw may be attached to the bottom of the pin once it is inserted into the orifice.

Figure 8:
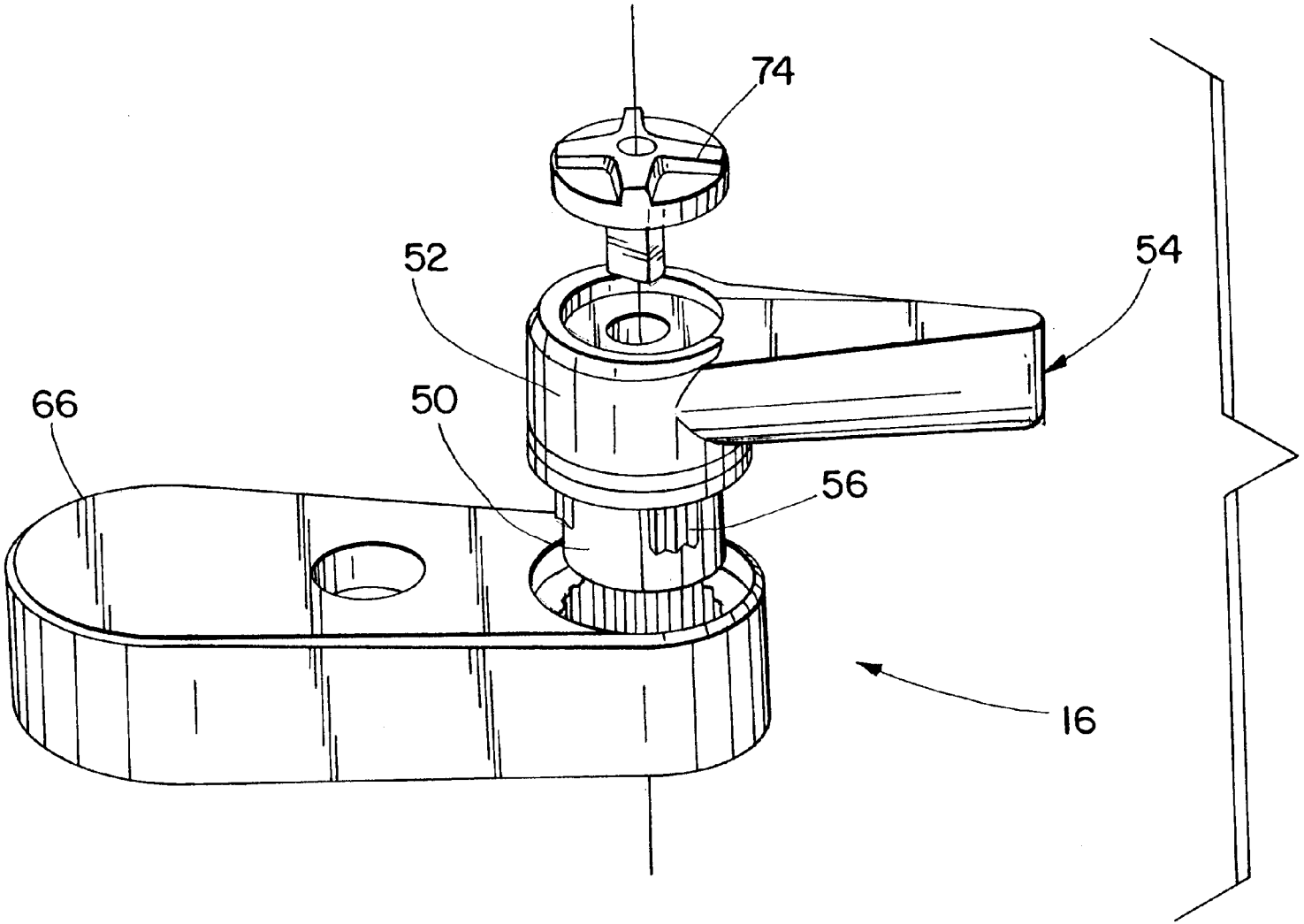
FIG. 8 illustrates a preferred embodiment of the pin and joint assembly of the present invention.

FIG. 8 illustrates another, preferred, embodiment, of the assembly of the present invention. In this embodiment the pin 50 is attached to a knuckle joint 52 which is attached to the end of the handle 54. A switch pin 74 preferably is used and preferably includes a portion which has cam lobes thereon (which will be described in greater detail below).

Figure 9:
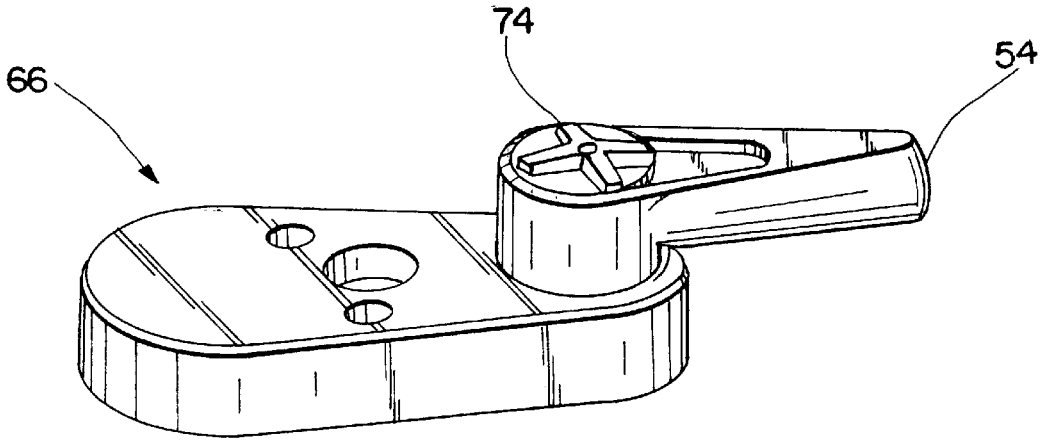
FIGS. 9 illustrates a perspective view of the present invention comprised of the preferred thrust gear pin and knuckle joint combination of FIG. 8.
Figure 10:
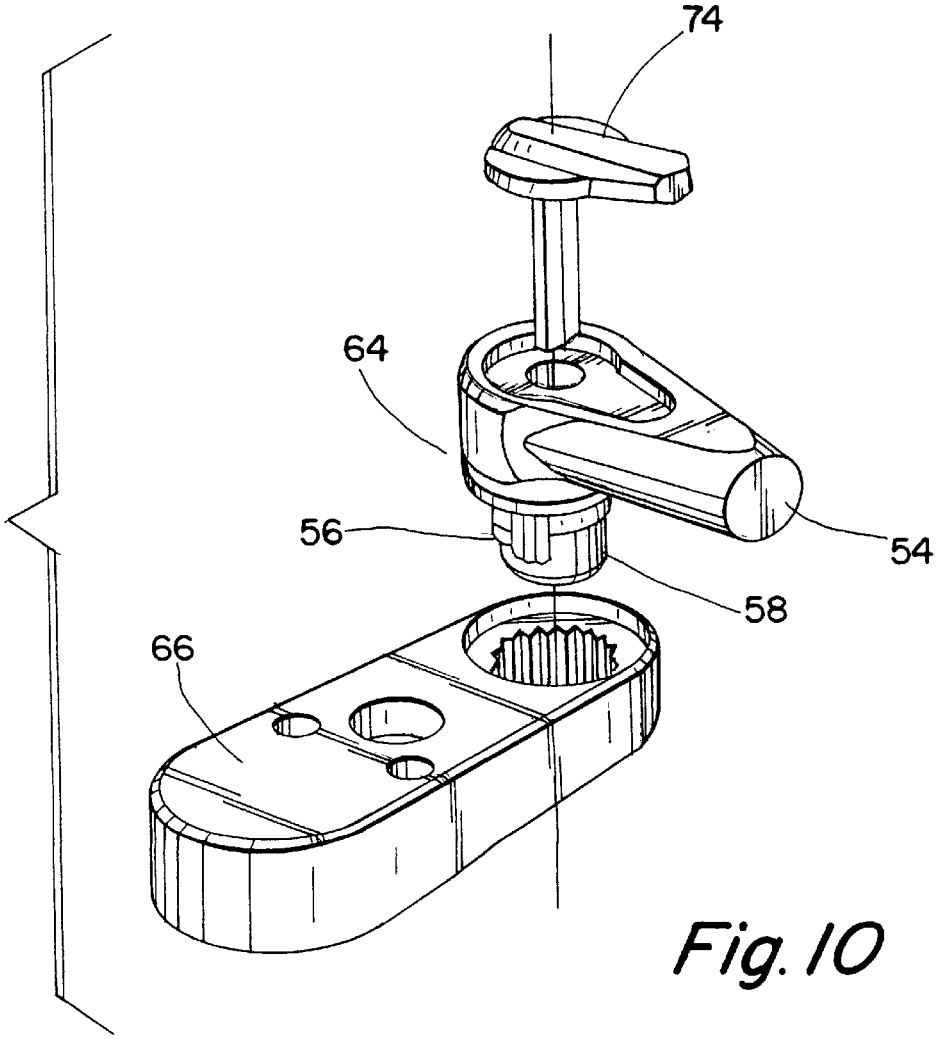
FIG. 10 illustrates another perspective view of the present invention comprised of the preferred thrust gear pin and knuckle joint combination of FIG. 8.

FIGS. 9 and 10 illustrate perspective views of the present invention comprised of the preferred pin 50 and knuckle joint 52 combination. The pin 50 is comprised of a thrust gear 56 and spring ring 58 which acts to engage the thrust gear 56 with the splines 60 within the cavity 62 in the head 66. An o-ring seal groove 64 and mating o-ring helps keep the joint secured within the head assembly.

Figure 11:
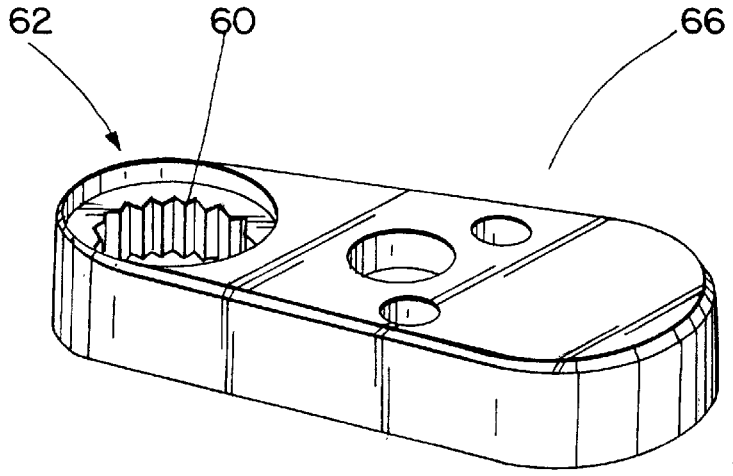
FIG. 11 illustrates a perspective view of a machined head assembly of FIG. 8.

FIG. 11 illustrates a perspective view of a machined head assembly 66. It is preferred that the machine splines 60 be a 24–36 teeth, 0.60 pitch diameter, spline.

Figure 12:
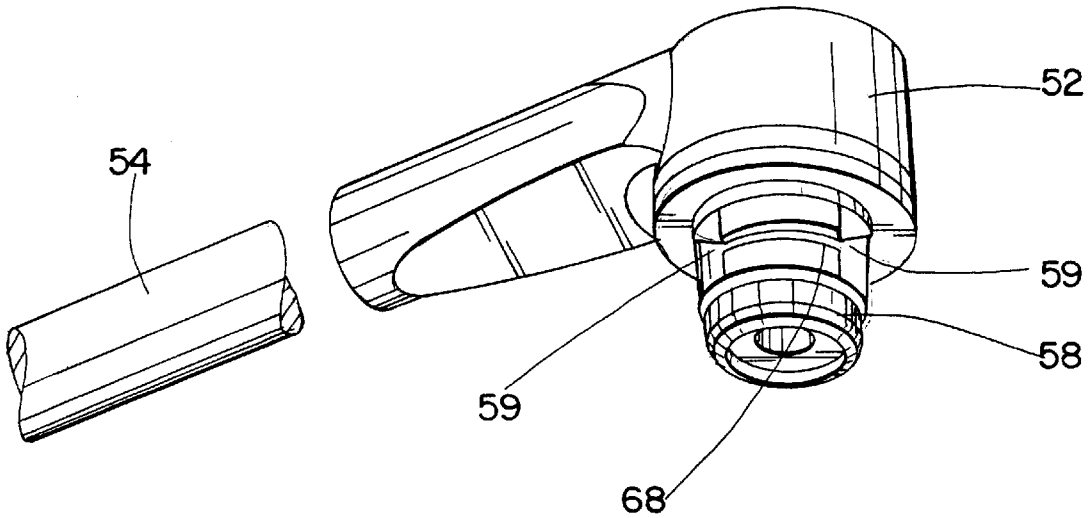
FIG. 12 illustrates a perspective view of a knuckle joint of FIG. 8.

FIG. 12 illustrates a perspective view of the knuckle joint 52. A spring ring groove 68 is shown in greater detail. The handle of the tool 54 can be of any desirable length. Thrust gear window(s) 59 are maintained at preferred intervals of 120 degrees around the pin 50 although other arrangements may work as well. The windows 59 are adapted to receive the thrust gears 56.

Figure 13:
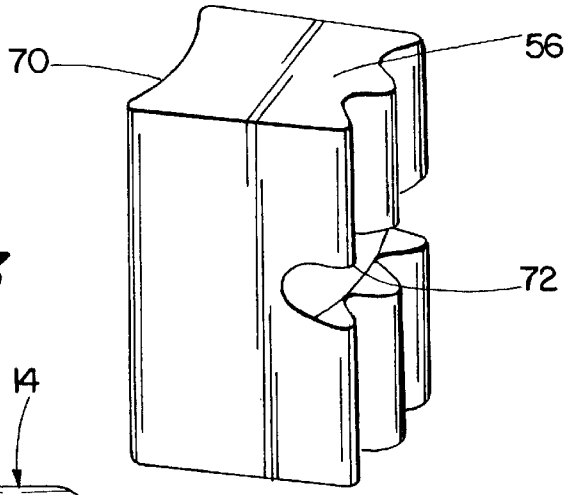
FIG. 13 illustrates a thrust gear of the present invention.

A preferred thrust gear 56 is illustrated in FIG. 13. The thrust gear 56 is preferably formed from a finished powder metal or extruded stock. The thrust gear 56 may have a radial contour 70 for switch cam operation. The thrust gear 56 may have a relief groove 72 for engaging the spring ring 58. It is preferred that the thrust gear 56 be formed of a 24–36 external involute spline tooth form with a 45 degree pressure angle and a 0.60 diameter pitch.

Figure 14:
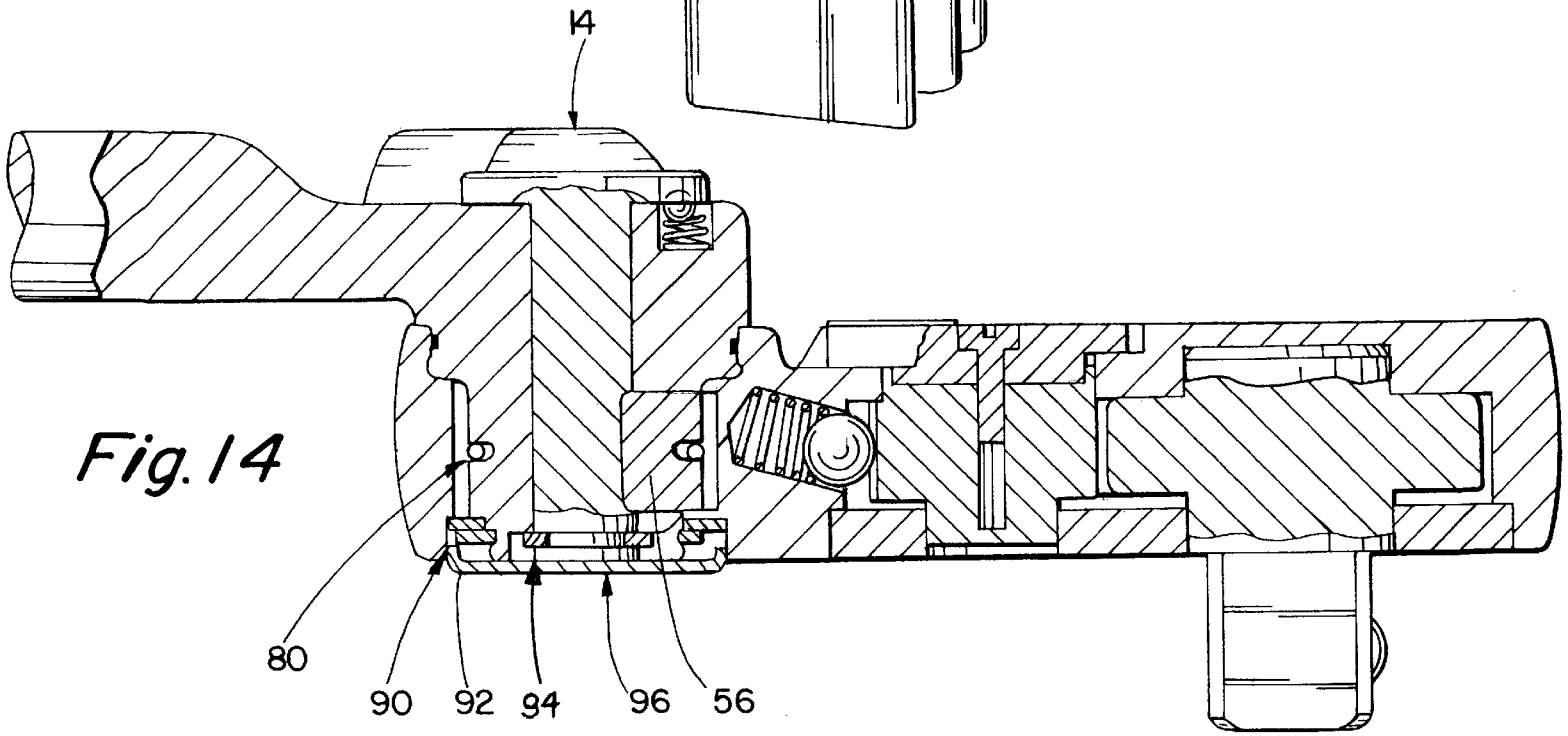
FIG. 14 illustrates a cross section view of the preferred arrangement of the present invention.

As shown in FIG. 14, upon actuation of the switch 74, a spring ring 58 circumferencing the lower body of the knuckle and the thrust gears 56 expands when the switch is turned and springs back disengaging the gears from the orifice splines 60 when the cams 82 on the switch pin are returned to a neutral position. When the thrust gear(s) 56 engages the splines of the orifice, it puts the tool in a locked position with respect to the orifice. Actuation of the switch 74 in the opposite direction causes the thrust gear(s) to unlock from the splined orifice 62.

A washer 90 and retaining ring 92 secure the structural integrity of the unit. A spring clip 94 holds the switch pin in place and a dust cap 96 keeps out dust and other harmful materials.

Figure 15A:
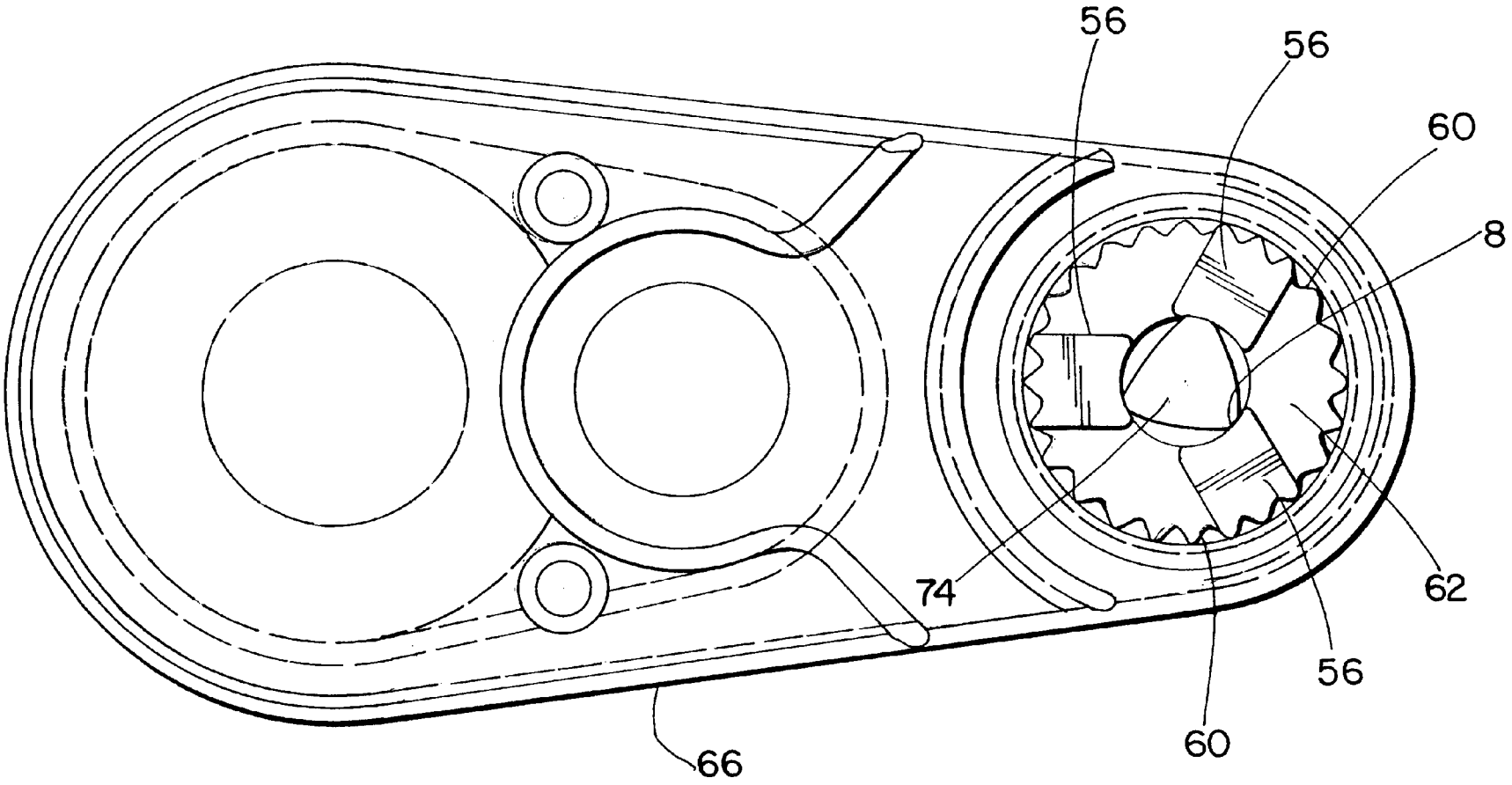
FIG. 15A illustrates a plan view of the head of the tool shown in FIG. 8 in an engaged position with the thrust gears.
Figure 15B:
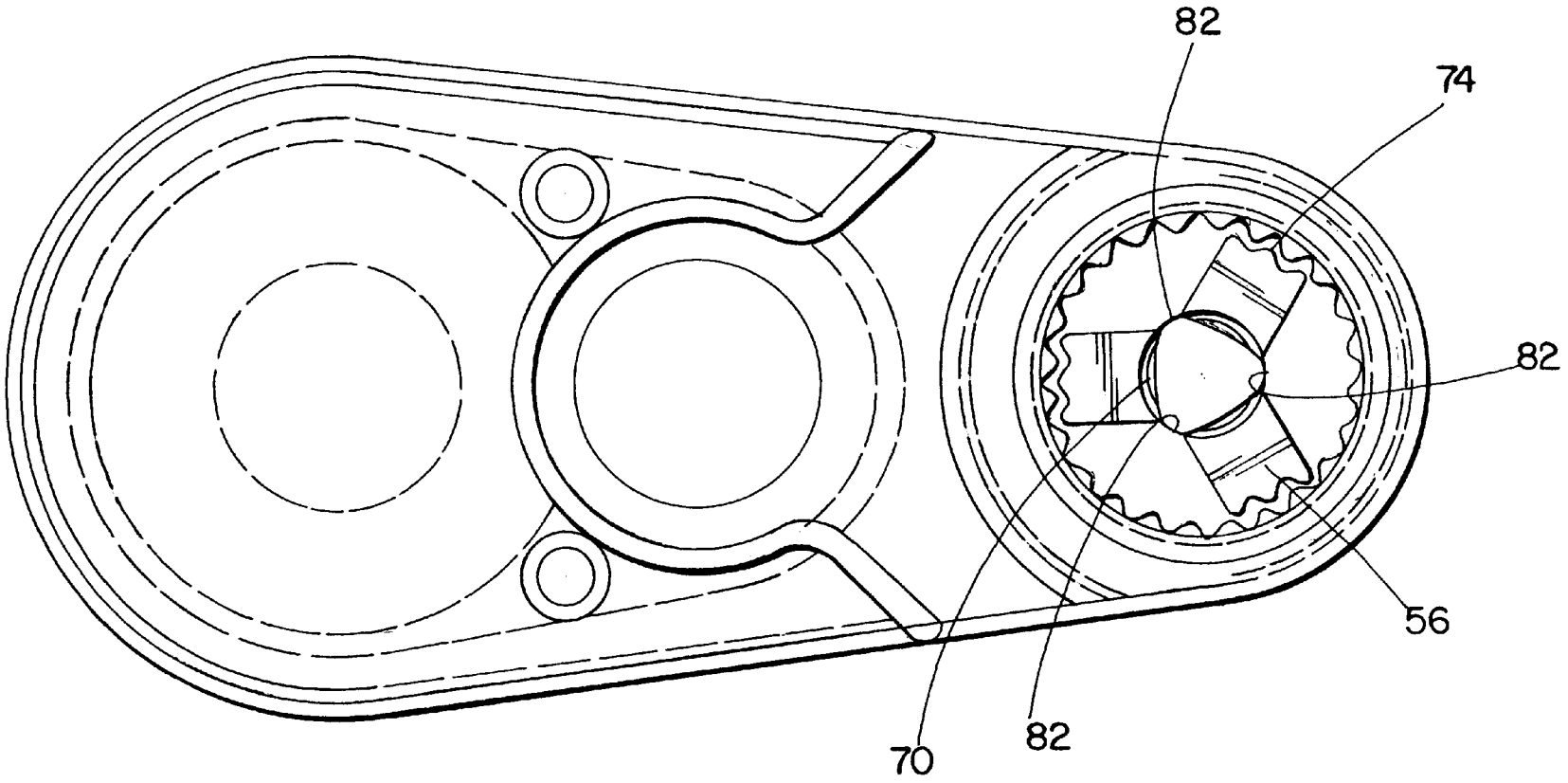
FIG. 15B illustrates a plan view of the head of the tool of FIG. 15A in a disengaged position.

FIG. 15A best shows the locked or engaged position while FIG. 15B best shows the unlocked or disengaged position. In both FIGS. 15A and 15B three thrust gears are shown. They are actuated by tuning of the switch pin which causes cam lobes 82 on the switch pin to be forced against the radial surface 70 of each of the thrust gears 56. The thrust gears are pushed out into contact with the splines of the orifice. When the switch pin is turned further the cam lobes disengage from the radial surfaces and the spring forces the thrust gears back to a neutral position away from engaging the splines. This same basic design could be accomplished with a number of mechanisms including a push button design. In this embodiment the push button would have a tapered pin. As the pin is depressed the wider part of the pin would push the thrust gears out into contact with the splines. To disengage, a spring may then be actuated to push the pin back up so that the wider portion of the tapered pin is removed from near the thrust gears resulting in the spring ring forcing the thrust gears out of engagement with the splines.

While the preferred embodiment of the invention has been shown and described, it will be apparent to those of ordinary skill in the art that various modifications may be made to this embodiment without departing from the spirit of the present invention and the scope of the following claims.

What is claimed is:

1. A wrench comprising:

a head;

a handle connected to said head;

a pin connecting said head to said handle, said pin having an extendible portion including male splines, said pin extending through an orifice in said head and said handle, said pin adapted to reside in one of two positions, a locked position and an unlocked position; and an actuator means for extending and retracting said extendible portion substantially without rotating said handle with respect to said head;

in said locked position said extendible portion being extended by said actuator means so that said male splines engage female splines of said orifice to prevent angular movement of said handle with respect to said head, and in said unlocked position said extendible portion being retracted by said actuator means, enabling said pin to rotate in said orifice.

2. The wrench according to claim 1, wherein said extendible portion is a thrust gear.

3. The wrench of claim 1, wherein the horizontal plane of said handle has a substantially constant relationship to the horizontal plane of said head.

4. The wrench of claim 1, wherein said actuator means is a push button mechanism.

5. The wrench of claim 1, wherein said actuator means is a switch pin.

6. The wrench of claim 5, wherein said switch pin includes at least one cam lobe.

7. The wrench of claim 1, wherein said handle is adapted to rotate through a total of 360° with respect to said head in said unlocked position.

8. A tool comprising:

a head;

a handle connected to said head;

a pin connecting said head to said handle, said pin having at least one extendible thrust gear including male splines, said pin extending through an orifice in said head and said handle, said pin adapted to reside in one of two positions, a locked position and an unlocked position; and an actuator means for extending or retracting said at least one extendible thrust gear substantially without rotating said handle with respect to said head;

in said locked position said at least one extendible thrust gear being extended by said actuator means so that said male splines engage female splines of said orifice to prevent angular movement of said handle with respect to said head, and in said unlocked position said at least one extendible thrust gear being retracted, by said actuator means, enabling said pin to in said orifice.

9. The tool of claim 8, wherein said actuator means is a push button mechanism.

10. The tool of claim 8, wherein said actuator means is a switch pin.

11. The tool of claim 10, wherein said switch pin includes at least one cam lobe.

12. The tool of claim 8, wherein the horizontal plane of said handle has a substantially constant relationship to the horizontal plane of said head.

13. The tool of claim 8, wherein said handle is adapted to rotate through a total of 360° with respect to said head in said unlocked position.

14. A wrench comprising:

a head;

a handle connected to said head;

a pin connecting said head to said handle, said pin having an extendible portion including male splines, said pin extending through an orifice in said head and said handle, said pin adapted to reside in one of two positions, a locked position and an unlocked position; and a push button mechanism adapted to extend and retract said extendible portion;

in said locked position said extendible portion being extended so that said male splines engage female splines of said orifice to prevent angular movement of said handle with respect to said head, and in said unlocked position said extendible portion being retracted, enabling said pin to rotate in said orifice.

15. A wrench comprising:

a head;

a handle connected to said head;

a pin connecting said head to said handle, said pin having an extendible portion including male splines, said pin extending through an orifice in said head and said handle, said pin adapted to reside in one of two positions, a locked position and an unlocked position; and a switch pin adapted to extend and retract said extendible portion;

in said locked position said extendible portion being extended so that said male splines engage female splines of said orifice to prevent angular movement of said handle with respect to said head, and in said unlocked position said extendible portion being retracted, enabling said pin to rotate in said orifice.

16. The wrench of claim 15, wherein said switch pin includes at least one cam lobe.

17. A tool comprising:

a head;

a handle connected to said head;

a pin connecting said head to said handle, said pin having at least one extendible thrust gear including male splines, said pin extending through an orifice in said head and said handle, said pin adapted to reside in one of two positions, a locked position and an unlocked position; and a push button mechanism adapted to extend and retract said at least one extendible thrust gear;

in said locked position said at least one extendible thrust gear being extended so that said male splines engage female splines of said orifice to prevent angular movement of said handle with respect to said head, and in said unlocked position said at least one extendible thrust gear being retracted, enabling said pin to rotate in said orifice.

18. A tool comprising:

a head;

a handle connected to said head;

a pin connecting said head to said handle, said pin having at least one extendible thrust gear including male splines, said pin extending through an orifice in said head and said handle, said pin adapted to reside in one of two positions, a locked position and an unlocked position; and a switch pin adapted to extend and retract said at least one extendible thrust gear;

in said locked position said at least one extendible thrust gear being extended so that said male splines engage female splines of said orifice to prevent angular movement of said handle with respect to said head, and in said unlocked position said at least one extendible thrust gear being retracted, enabling said pin to rotate in said orifice.

19. The tool of claim 18, wherein said switch pin includes at least one cam lobe.

* * * * *